US006077153A

United States Patent [19]

Fujita et al.

[11] Patent Number: 6,077,153

[45] Date of Patent: Jun. 20, 2000

[54] POLISHING PAD AND APPARATUS FOR POLISHING A SEMICONDUCTOR WAFER

[75] Inventors: Takashi Fujita; Yuzo Kozai, both of Amagasaki; Motoyuki Ohara, Nishinomiya, all of Japan

[73] Assignee: Sumitomo Metal Industries, Limited, Osaka, Japan

[21] Appl. No.: 08/978,694

[22] Filed: Nov. 26, 1997

[30] Foreign Application Priority Data

Nov. 29, 1996 [JP] Japan ..... 8-319181

[51] Int. Cl.[7] ..... B24B 5/00

[52] U.S. Cl. ..... 451/259; 451/287; 451/533; 451/550

[58] Field of Search ..... 451/287, 285, 451/288, 286, 259, 533, 550

[56] References Cited

U.S. PATENT DOCUMENTS

| | | | |
|---|---|---|---|
| 5,020,283 | 6/1991 | Tuttle . | |
| 5,177,908 | 1/1993 | Tuttle . | |
| 5,212,910 | 5/1993 | Breivogel et al. . | |
| 5,287,663 | 2/1994 | Pierce et al. . | |
| 5,839,947 | 11/1998 | Kimura et al. | 451/288 |
| 5,851,846 | 12/1998 | Matsui et al. | 438/17 |
| 5,860,851 | 1/1999 | Beppu et al. | 451/41 |
| 5,876,269 | 3/1999 | Torii | 451/41 |
| 5,879,220 | 3/1999 | Hasegawa et al. | 451/288 |

FOREIGN PATENT DOCUMENTS

| | | |
|---|---|---|
| 05555660A2-A3 | 1/1993 | European Pat. Off. . |
| 0658401A1 | 6/1995 | European Pat. Off. . |
| 59-022329 | 4/1984 | Japan . |
| 05285825 | 2/1993 | Japan . |
| 5-285825 | 2/1993 | Japan . |

*Primary Examiner*—Timothy V. Eley
*Attorney, Agent, or Firm*—Barnes & Thornburg

[57] ABSTRACT

An apparatus for polishing a semiconductor wafer includes a polishing pad to be in contact with the semiconductor wafer; a turn table which rotates the polishing pad; and an elastic member which is arranged between the turn table and the polishing pad. The polishing pad includes a polishing layer which is made of a material having a good characteristic of slurry holding; and a support layer which is made of a rigid material having an optimum thickness to prevent the polishing layer from loosening. The polishing pad is attached to the turn table by a stretch-holding technique without adhesive bonding.

22 Claims, 11 Drawing Sheets

POLISHING PAD AND APPARATUS FOR POLISHING A SEMICONDUCTOR WAFER

CROSS REFERENCE TO RELATED APPLICATION

This application claims the priority of Application No. H08-319181, filed Nov. 29, 1996 in Japan, the subject matter of which is incorporated herein by reference.

TECHNICAL FIELD OF THE INVENTION

The present invention relates to a polishing pad and an apparatus for polishing a flat plate object, such as a semiconductor wafer. And more particularly, the invention relates to a polishing pad and an apparatus for polishing a semiconductor wafer, in which the polishing pad is attached to a turn table with a stretch-holding technique without adhesive bonding.

BACKGROUND OF THE INVENTION

In general, integrated circuit (IC) devices manufactured today rely upon an elaborate system of conductive interconnects for wiring together transistors, resistors, and other IC components which are formed on a semiconductor substrate. The technology for forming these interconnects is highly sophisticated and well understood by practitioners skilled in the art. In a typical IC device manufacturing process, many layers of interconnects are formed over a semiconductor substrate, each layer being electrically insulated from adjacent layers by an interposing dielectric layer. It is important that the surface of these interposing dielectric layers be as flat, or planar, as possible to avoid problems associated with optical imaging and step coverage which could frustrate the proper formation and performance of the interconnects.

As a result, many planarization technologies have evolved to support the IC device manufacturing industry. One such technology is called chemical mechanical polishing or planarization (CMP). CMP includes the use of lapping machines and other chemical mechanical planarization processes to smooth the surface of a layer, such as a dielectric layer, to form a planar surface. This is achieved by rubbing the surface with an abrasive material, such as polishing pad, to physically etch away rough features of the surface. Rubbing of the surface may be performed in the presence of certain chemicals which may be capable of chemically etching the surface as well. After a dielectric layer has been sufficiently smoothed using CMP, interconnects may be accurately and reliably formed on the resulting planar surface.

When a wiring pattern is formed on a wafer and then an insulating layer is formed over the entire surface, the insulating layer may have protrusions (surface topography), because some areas are located over the wiring pattern and the other areas are not located over the wiring pattern. In the polishing process of the insulating layer, the protrusions of the insulating layer are flattened uniformly. In this process, it is required that a polishing pad conforms to deflections (global waviness) of the wafer and polishe local topographies on the wafer well to flatten the surface of the wafer uniformly.

For example, when a soft polishing pad is used, the pad conforms even to the local topographies of the insulating layer, because the polishing pad itself elastically deforms. As a result, the polishing pad polishes not only projected portions but also depressed portions as well. This means that it is difficult to flatten local topographies on the insulating layer.

On the other hand, when a rigid polishing pad is used, the pad tends to polish only the projected portions in the global deflection of the wafer, but not polish the local topographies uniformly. As a result, it is difficult to polish the insulating layer uniformly in a global range.

Accordingly, in order that the polishing pad conforms to the deflections (global waviness) of the wafer and flattens the local topographies well, a variety of improved polishing apparatuses have been proposed. For example, in U.S. Pat. No. 5,212,910, an improved polishing apparatus is described. The apparatus includes a first layer, a second layer and a third layer. The first layer is made of an elastic material such as spongy rubber or foam rubber, and is attached to a turn table. The second layer is made of a rigid material such as epoxy, segmented into individual sections by grooves. The second layer is attached to the first layer. The third layer is made of a porous material having a good slurry-transportability, such as Rodel SUBA500 (Product No.). The third layer is in contact with the silicon wafer to polish.

In the conventional apparatus, each segmented section of the rigid material (the second layer) moves vertically while being cushioned by the elastic material of the first layer, so that the polishing pad (third layer) can conform to the global deflections of the wafer surface. Each segmented section of the second layer is not deformed, so that the polishing pad is flatly in touch with the local protrusions on the wafer. As a result, the polishing pad conforms to the global deflections of the wafer, and at the same time, well polishes the local protrusions.

In such a polishing apparatus, the polishing pad can be attached to the turn table with two different ways (techniques). According to one technique, the whole surface of the polishing pad is adhesive-bonded to the turn table, which is hereinafter called "adhesive-bonding technique." According to the other technique, the polishing pad is stretched with a predetermined tension and is held on to the turn table without adhesive bonding, which is hereinafter called "stretch-holding technique."

According to the adhesively-bonding technique, some air bubbles may get into a space between the turn table and the polishing pad during the attachment process of the polishing pad, because the polishing pad is adhesively-bonded to the turn table, for example with a double-sided tape. If air bubbles get into the space, the polishing pad is locally protruded. The polishing rate at the protruded portion becomes larger locally, therefore, the wafer is not polished uniformly. For that reason, the attachment accuracy varies depending on the operator who installs the polishing pad, therefore, it is required to attach the polishing pad to the turn table by an experienced operator.

In general, the polishing pad is frequently changed to new one, therefore, the attachment accuracy of the polishing pad is not stable, and it is difficult to perform a polishing process accurately. As a result, the polishing apparatus itself does not always work well, and the operating efficiency of the apparatus is decreased. Further, when the polishing pad is removed from the turn table, some small pieces of the double-sided tape may remain on the turn table. It is required to remove all the remains.

On the other hand, when the polishing pad is attached to the turn table by the stretch-holding technique, air bubbles do not easily get into the space between the polishing pad and the turn table. Even though, some air bubbles get into the space, those are easily taken out. Therefore, the polishing pad can be easily attached to the turn table by an inexperienced operator. The polishing quality is maintained high, because the attachment accuracy of the polishing pad is stable independently from the operator who attaches the polishing pad. Accordingly, the polishing pad conforms to the global deflections of the wafer, and at the same time, well polishes the local protrusions on the wafer.

In Japanese Laying Open Kokai No. H5-285825, a polishing apparatus includes an elastic member between a turn table and a polishing pad. The polishing pad is attached to the turn table by the stretch-holding technique. In this apparatus, the elastic member is arranged between the polishing pad and the turn table, so that the polishing pad conforms to global deflections of the wafer. The polishing pad is made of rigid material, so that local protrusions on the wafer are polished and flattened well. The polishing pad is attached to the turn table by the stretch-holding technique, so that the apparatus has no disadvantages caused by the adhesively-bonding technique.

In this apparatus, the polishing pad is not bonded to the elastic member, but is held with a predetermined tension. The polishing pad is made of a material which is rigid and well holds a polishing slurry. The material, which holds the polishing slurry well, may be of foamed material having a high degree of swelling, so that the polishing pad is swelled and deformed when absorbing the polishing slurry. When the polishing pad is swelled, the attachment between the polishing pad and the turn table gets loose.

Further, when the polishing process is repeated many times, shear stress makes wrinkles in the shear direction (direction in which the polishing pad and the flat plate object are rubbed) on the polishing pad. When the wrinkles are made on the polishing pad, a part of the wafer is locally over polished, so that the entire surface of the wafer is not polished uniformly. Especially in an apparatus that performs a dressing process of a polishing pad, the polishing pad is locally over dressed at portions where the wrinkles formed, so that the entire surface of the wafer is not polished uniformly. In other words, specific regions of the polishing pad are locally over shaved, therefore, the polishing pad can not be used over a long period of time.

OBJECT(S) OF THE INVENTION

Accordingly, an object of the invention is to provide a polishing pad and an apparatus for polishing a semiconductor wafer, in which the polishing pad does not have any wrinkles thereon and the semiconductor wafer can be polished uniformly over a long period of time.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to a first aspect of the invention, an apparatus for polishing a semiconductor wafer, includes a polishing pad to be in contact with the semiconductor wafer; a turn table which rotates the polishing pad; and an elastic member which is arranged between the turn table and the polishing pad. The polishing pad includes a polishing layer which is made of a material having a good characteristic of slurry holding; and a support layer which is made of a rigid material having an optimum thickness to prevent the polishing layer from loosening. The polishing pads attached to the turn table by a stretch-holding technique without adhesive bonding.

According to a second aspect of the invention, a polishing pad, which is attached to a turn table by a stretch-holding technique without adhesive bonding, includes a polishing layer which is made of a material having a good characteristic of slurry holding, and is in contact with a semiconductor wafer to polish; and a support layer which is made of a rigid material having an optimum thickness to prevent the polishing layer from loosening.

DETAILED DISCLOSURE OF THE INVENTION

Figure 1:
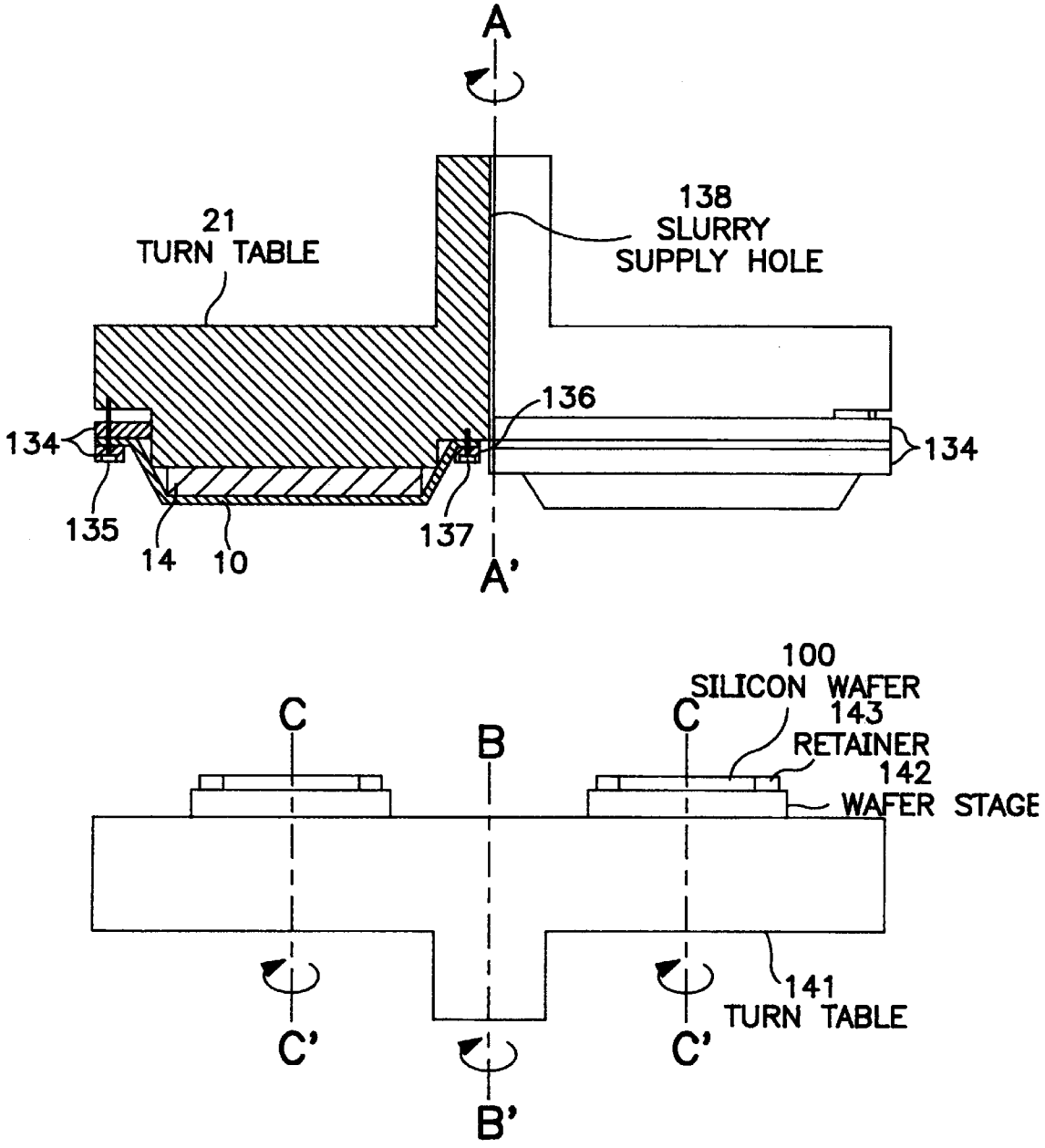
FIG. 1 is a side view (partially cross-sectional) conceptually showing a polishing apparatus according to a first preferred embodiment of the invention.
Figure 2:
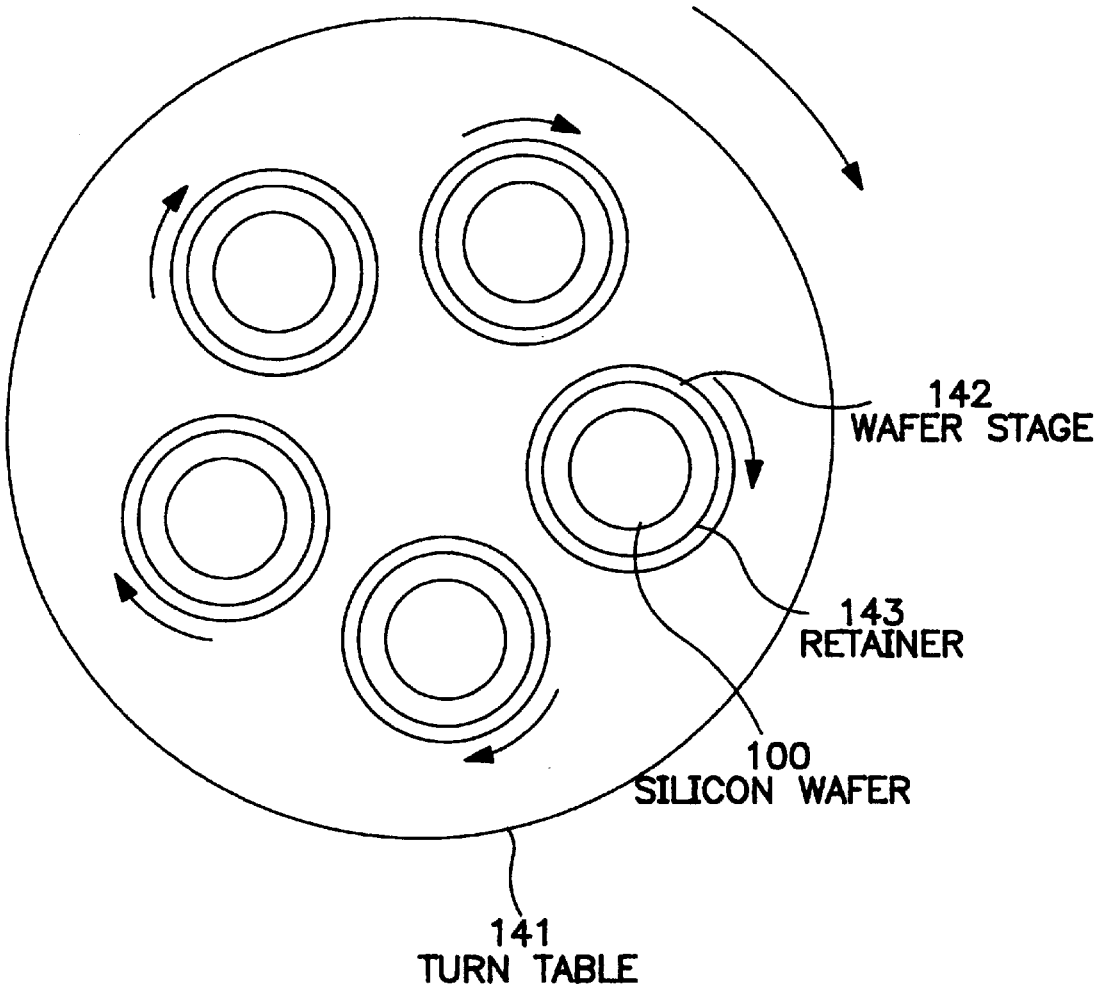
FIG. 2 is a plan view showing a wafer turn table used in the polishing apparatus shown in FIG. 1.

FIG. 1 shows an apparatus for polishing a silicon wafer 100, according to a first preferred embodiment of the invention. The apparatus includes a turn table 21, a polishing pad 10 attached to the turn table 21, an elastic member 14 sandwiched between the turn table 21 and the polishing pad 10, a wafer turn table 141, a wafer stage 142 and a retainer 143 holding the wafer 100.

The elastic member 14 is shaped to be a ring-shape having a center hole, and is fixed to the turn table 21 with a double-sided tape, or the like. The elastic member 14 is carefully attached to the turn table 21 so that no air bubbles get into the space between them. Basically, once the elastic member 14 is attached to the turn table 21, the elastic member 14 is not often changed to new one. The polishing pad 10 is also shaped to be a ring-shape, and is attached with inner ring 136 and periphery ring 134 and bolts 137 and 135 to the bottom of the turn table 21. The wafer stage 142 is rotatably mounted on the wafer turn table 141. The retainer 143 is fixed on the wafer stage 142.

The turn table 21, the wafer turn table 141 and the wafer stage 142 are designed to rotate on axes A–A', B–B' and C–C', respectively. Diamond is mounted to the retainer 143 by electrodeposition technique. The polishing pad 10 is dressed with the retainer 143 during the polishing process. A polishing slurry is supplied from a slurry supply hole 138 vertically extending through the center of the turn table 21.

Figure 4:
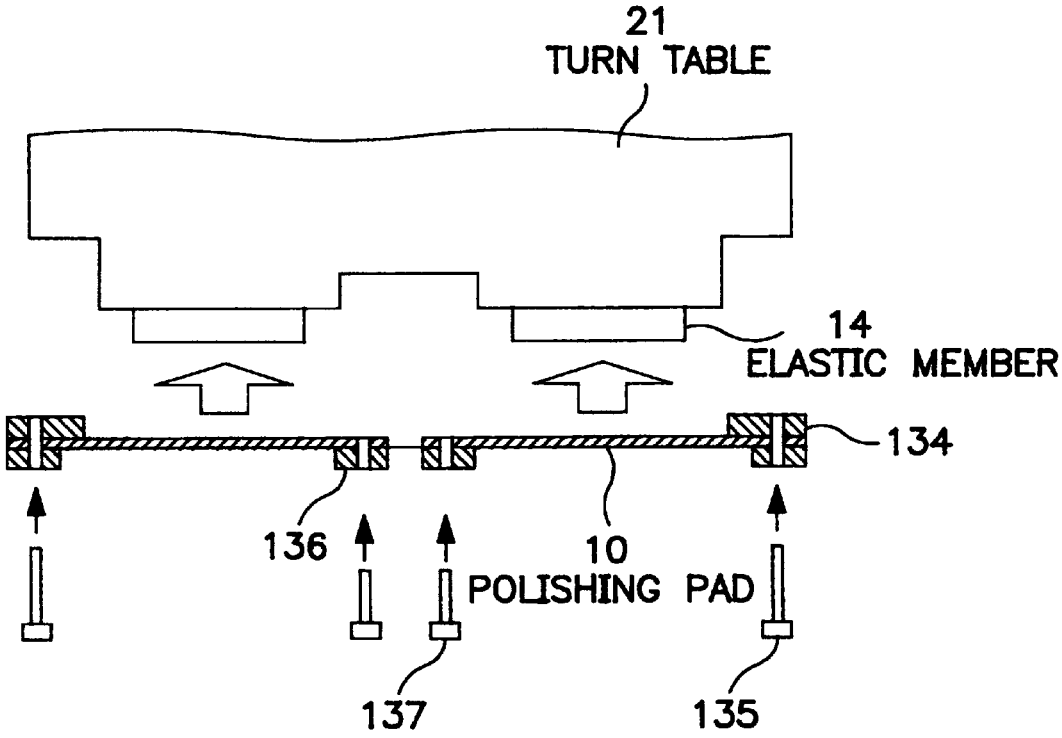
FIG. 4 is a side view (partially cross-sectional) conceptually showing a process of a stretch-holding technique to attach the polishing pad to a turn table in the apparatus shown in FIG. 1.

As shown in FIG. 4, the polishing pad 10 is attached to the turn table 21 as follows: The polishing pad 10 is, in advance, fixed at the inner and periphery edges to the inner ring 136 and the periphery ring 134, respectively. Next, the polishing pad 10 is positioned below the turn table 21. Then, the inner ring 136 and periphery ring 134 are fixed to the turn table with bolts 135 and 137, respectively, to stretch and hold the polishing pad 10 to the turn table 21.

Now, steps of polishing an insulating layer formed on the silicon wafer 100 using the above mentioned polishing apparatus is, described. First, the silicon wafer 100 is put on the wafer stage 142. Then, the turn table 21 is rotated on the axis of A–A', the wafer turn table 141 is rotated on the axis of B–B', and the wafer stage 142 is rotated on the axis C–C'. While supplying the polishing slurry from the slurry supply hole 138, the turn table 21 descends toward the wafer 100 and the polishing pad 10 is pressed against the wafer 100 to polish the wafer 100 at a predetermined load.

The polishing apparatus is provided with the above-described polishing pad 10 and the elastic member 14, so that the insulating layer on the silicon wafer can be polished uniformly over a long period of time.

Figure 3:
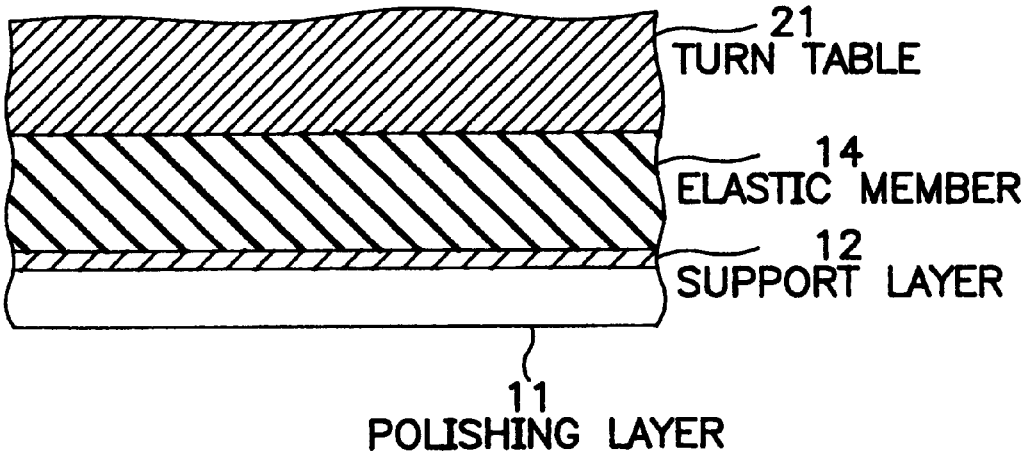
FIG. 3 is a cross-sectional view conceptually showing a polishing pad equipped in the polishing apparatus, shown in FIG. 1.

FIG. 3 shows the inside structure of the polishing pad 10, which includes a polishing layer 11 and a support layer 12. The support layer 12 is attached (not adhesively bonded) to the elastic member 14, which is fixed to the turn table 21. In other words, the elastic member 14 is sandwiched between the turn table 21 and the support layer 12.

The polishing layer 11 is preferably made of porous urethane or made of polyester fibers impregnated with urethane resin to remain porosities therein. For instance, Rodel IC1000, IC1400, SUBA800 or the like can be used as the polishing layer 11. The polishing layer 11 is preferably designed to have a thickness of 1 mm to 2 mm. To improve transportability of the polishing slurry between the polishing layer 11 and the silicon wafer 100, the polishing layer 11 may be provided with later-described grooves.

The support layer 12 is made of a material that easily bends, but is inelastic and has a low degree of swelling to the polishing slurry. Namely, the support layer 12 is designed to have a flexibility to conform to the elastic member 14, to have a horizontal strength not to generate wrinkles, and to have a low degree of swelling to the polishing slurry. For instance, a polyethylene sheet, a super-macromolecule polyethylene sheet, an acrylic sheet, a teflon sheet, a polypropylene sheet, a polyurethane sheet, a polyester sheet, or the like can be used for the support layer 12. The support layer 12 is preferably designed to have a thickness of 0.05 mm to 1 mm. Such a thickness, however, depends on the material.

The polishing layer 11 and the support layer 12 are adhesively-bonded entirely to each other using a double-sided tape, or by thermal contact bonding technique with adhesive.

The elastic member 14 is preferably made of a material that does not deforms with time, and have a low degree of swelling to the polishing slurry. For instance, nitrile rubber, neoprene rubber, chloroprene rubber, silicon rubber, fluorine rubber, or the like can be used for the elastic member 14. The elastic member 14 is preferably designed to have a thickness of 1 mm to 10 mm.

According to the polishing apparatus, even though the polishing layer 11 absorbs the polishing slurry, swells and deforms, the support layer 12 prevents the polishing layer 11 from loosening in the shear direction during the polishing process, therefore the polishing layer 11 is prevented from having wrinkles thereon. As a result, the polishing rate distribution on the silicon wafer 100 can be uniform.

Figure 5:
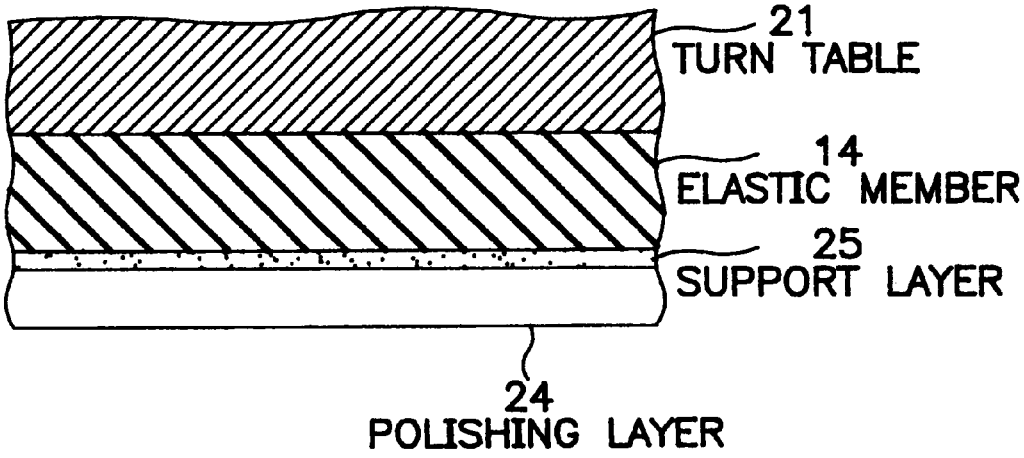
FIG. 5 is a cross-sectional view conceptually showing a polishing pad equipped in a polishing apparatus according to a second preferred embodiment of the invention.

FIG. 5 shows a polishing pad equipped in a polishing apparatus according to a second preferred embodiment of the invention, which includes a polishing layer 24 and a support layer 25. In this embodiment, the same or corresponding elements to the above described first preferred embodiment are represented by the same reference numbers. And, the same description is not repeated to prevent redundant description. The polishing pad (24 and 25) can be applied to the apparatus of the first preferred embodiment, shown in FIG. 1. The difference from the first preferred embodiment, is that the polishing layer 24 and the support layer 25 are integrally formed from the same material. In more detail, the polishing layer 24 and the support layer 25 are made of a material, having a good slurry-transportability. The support layer 25 is designed to have an optimum thickness as a part of the polishing layer 24.

The polishing layer 24, for instance, is made of porous urethane or made of polyester fibers impregnated with urethane resin to remain porosities therein. For instance, Rodel IC1000, IC1400, SUBA800 or the like can be used as the polishing layer 24. Urethane resin having a higher viscosity is impregnated from the rear surface of the polishing layer 24 to a predetermined depth thereof. This high viscosity urethane resin goes to a point where one third of the whole thickness of the polishing pad (24 and 25), but does not go through the polishing pad because of the high viscosity.

For impregnating such a high viscosity urethane resin into the polishing layer 24, for example, urethane resin is dissolved in either system of solvent to have a viscosity between 10,000 cP to 12,000 cP. Then, the solvent may be rubbed into the rear surface of the polishing layer with a roller in an atmosphere of 100° C. to 150° C.

In thus fabricated polishing pad (24 and 25), the portion into which no urethane resin is impregnated has a high slurry transportability, and the other portion into which the urethane resin is impregnated has a low slurry transportability (degree of swelling) and is inelastic because the porosities are filled with the resin. Accordingly, the polishing layer 24 and the rigid support layer 25 are formed integrally from the same material.

In the same manner as the first preferred embodiment, the polishing layer 24 may be provided with later-described grooves to improve slurry transportability between the silicon wafer 100 and the polishing pad (24 and 25).

According to the polishing pad (24 and 25) of the second preferred embodiment, the polishing layer 24 is prevented from having, wrinkles thereon, therefore the polishing rate distribution on the silicon wafer 100 can be uniform. In addition, the polishing layer 24 and the support layer 25 are can be integrally formed easily.

Figure 6:
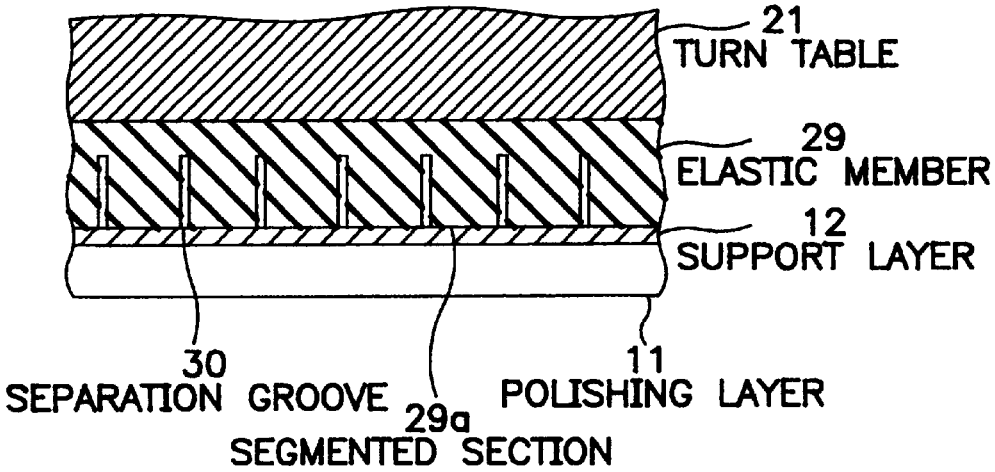
FIG. 6 is a cross-sectional view conceptually showing a polishing pad equipped in a polishing apparatus according to a third preferred embodiment of the invention.

FIG. 6 shows a polishing pad equipped in a polishing apparatus according to a third preferred embodiment of the invention. In this embodiment, the same or corresponding elements to the above described other embodiments are represented by the same reference numbers. And, the same description is not repeated to prevent redundant description. The feature of the embodiment is to include a special shape of elastic member 29. The elastic member 29 is provided at the lower surface with separation grooves 30 to segment it into individual sections 29*a*, that is the difference from the first embodiment. The apparatus includes the same polishing pad (11 and 12) as that of the first preferred embodiment, and can be applied to the apparatus of the first preferred embodiment, shown in FIG. 1.

Figure 7A:
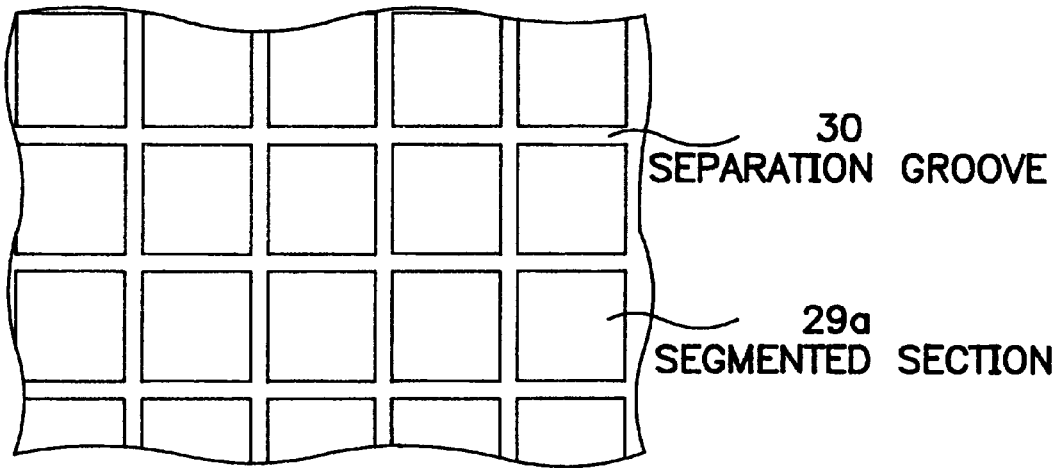
FIG. 7A is a plan view conceptually showing a groove pattern of an elastic member included in the polishing pad, shown in FIG. 6.

FIG. 7A shows a pattern example of the separation grooves 30 of the elastic member 29. The separation grooves 30 segment the lower surface of the elastic member 29 into a number of square sections.

Figure 7B:
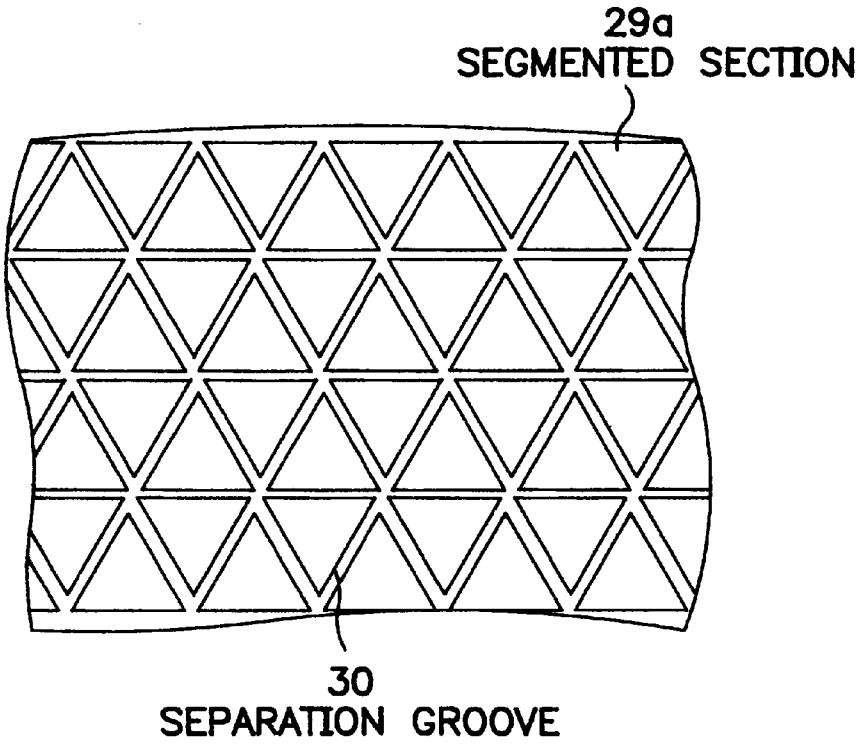
FIG. 7B is a plan view conceptually showing another groove pattern of the elastic member included in the polishing pad, shown in FIG. 6.

FIG. 7B shows another pattern example of the separation grooves 30 of the elastic member 29. The separation grooves 30 segment the lower surface of the elastic member 29 into a number of triangle sections.

The separation grooves 30 are designed to have an appropriate width so that each segmented section is neither deformed individually, nor deformed by a "pressure-rebound effect." The pressure-rebound effect means an effect in which when the elastic member 29 is depressed in response to vertical pressure, neighboring regions of the depressed region are protruded to have a volume corresponding to that of the depressed region. If the pressure-rebound effect occurs, the silicon wafer 100 is pressed by the protruded portions of the polishing pad with larger pressure, and therefore, the pressure distribution to the silicon wafer 100 becomes not uniform.

The separation grooves 30, for instance, has a width of 0.5 mm to 2 mm. The separation grooves 30 are designed to have an appropriate spacing from the adjacent grooves so that semiconductor chip patterns are properly formed on the silicon wafer 100. For instance, the spacing may be 10 mm to 30 mm. Each separation groove 30 preferably has a depth of 0.5 mm to 8 mm. Any shape of groove pattern is applicable to the elastic member 29.

The elastic member 29 is provided with the grooves 30 so that the polishing pad (11 and 12) is prevented from being deformed due to pressure-bound effect. Therefore, the silicon wafer 100 can be polished with a uniform distribution of polishing rate.

Figure 8:
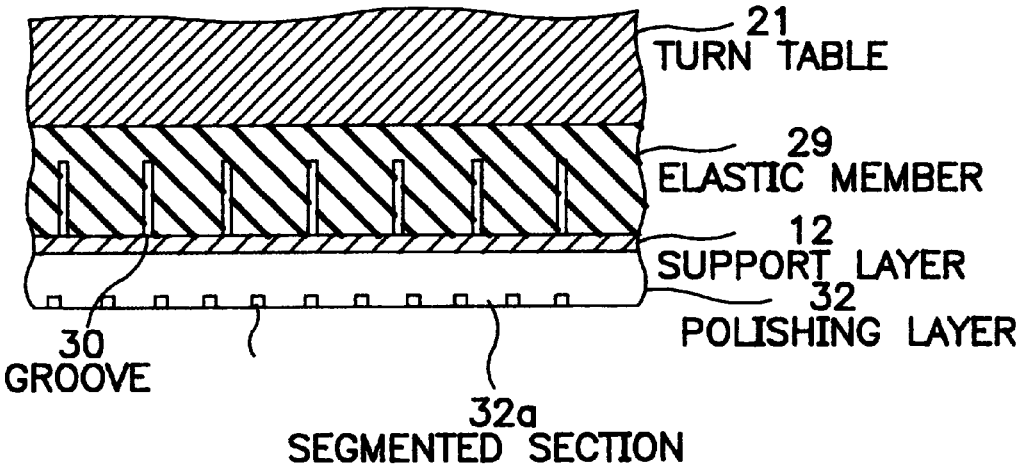
FIG. 8 is a cross-sectional view conceptually showing a polishing pad equipped in a polishing apparatus according to a fourth preferred embodiment of the invention.

FIG. 8 shows a unique polishing pad (12 and 32) ani an elastic member 29 used in a polishing apparatus, according to a fourth preferred embodiment of the invention. In this embodiment, the same or corresponding elements to the above described other embodiments are represented by the same reference numbers. And, the same description is not repeated to prevent redundant description. The polishing pad includes a polishing layer 32 which is provided at the lower surface with grooves 35 to improve slurry transportability between the wafer 100 and the polishing pad (12 and 32). The elastic member 29 and the polishing pad (12 and 32) can be applied to the apparatus shown in FIG. 1.

Figure 9:
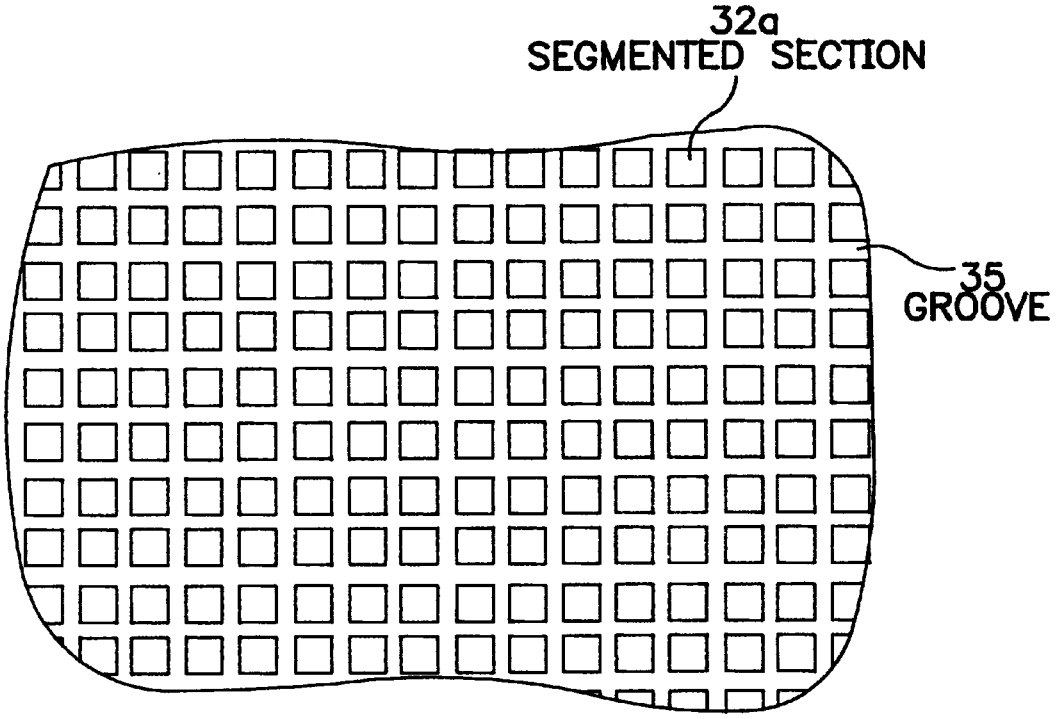
FIG. 9 is a plan view conceptually showing a groove pattern of a polishing layer included in the polishing pad, shown in FIG. 8.

FIG. 9 shows an example pattern of the grooves 35 formed on the polishing layer 32. The polishing layer 32 is segmented by the grooves 35 into a number of individual square sections 32*a*. The grooves 35, for example, are designed to have a width of 1 mm to 5 mm, a depth of 0.5 mm to 0.8 mm and a spacing of 10 mm to 30 mm.

Figure 10:
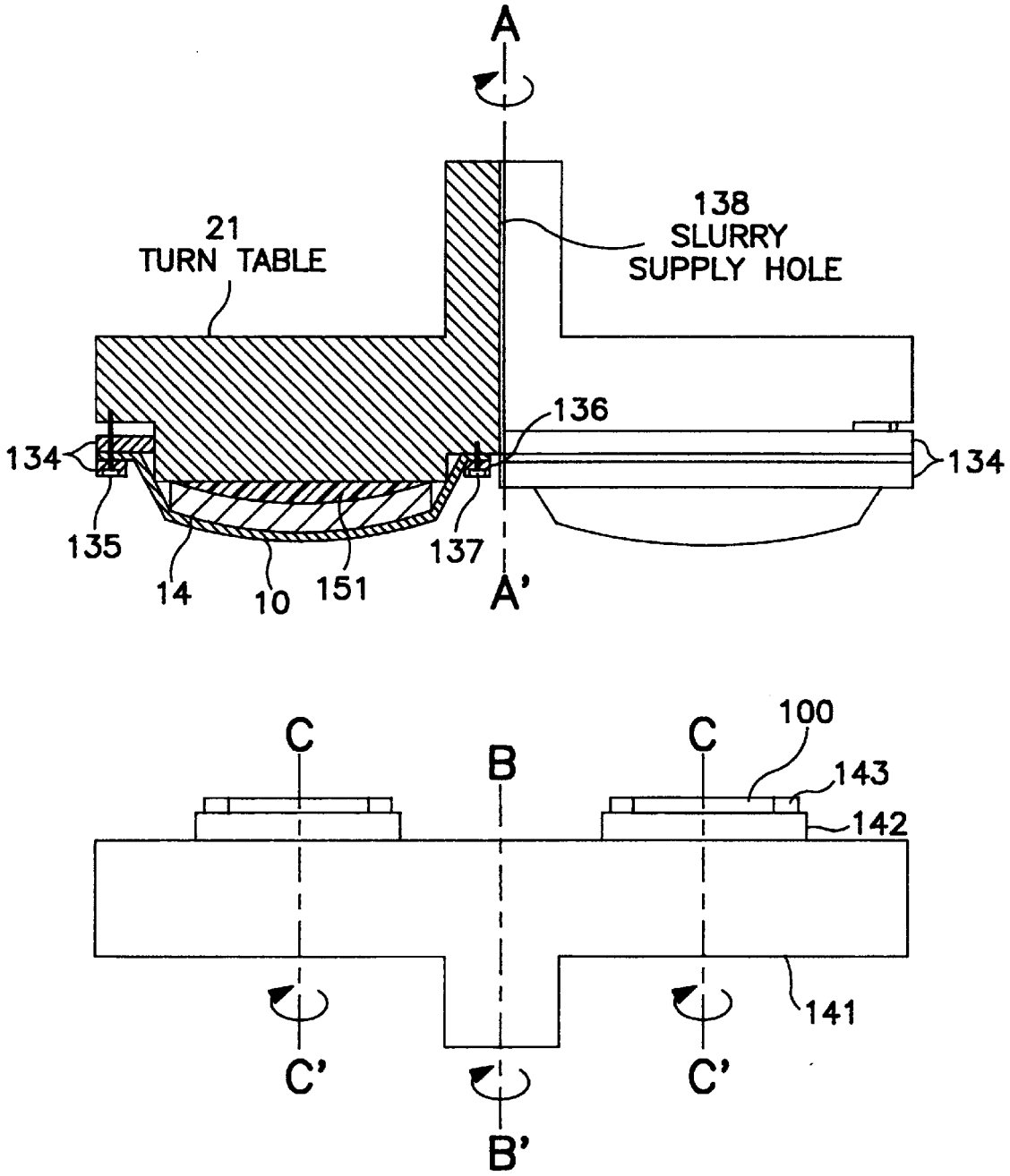
FIG. 10 is a side view (partially cross-sectional) conceptually showing a polishing apparatus according to a fifth preferred embodiment of the invention.

FIG. 10 shows a polishing apparatus according to a fifth preferred embodiment of the invention. Any of the above mentioned elastic members and polishing pads of the first to fourth preferred embodiments are applicable to the apparatus, shown in FIG. 10. In this embodiment, the same or corresponding elements to the above described other embodiments are represented by the same reference numbers. And, the same description is not repeated to prevent redundant description. The apparatus includes a convex member 151 between the elastic member 14 and the turn table 21, that is the difference from the apparatus shown in FIG. 1.

Figure 11A:
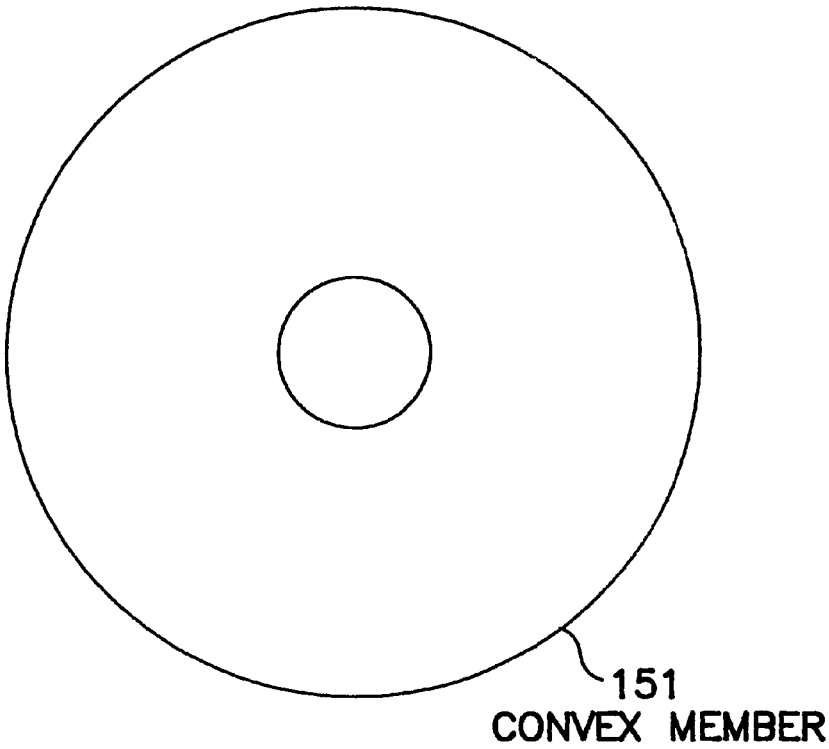
FIG. 11A is a plan view conceptually showing a convex member used in the apparatus shown in FIG. 10.
Figure 11B:
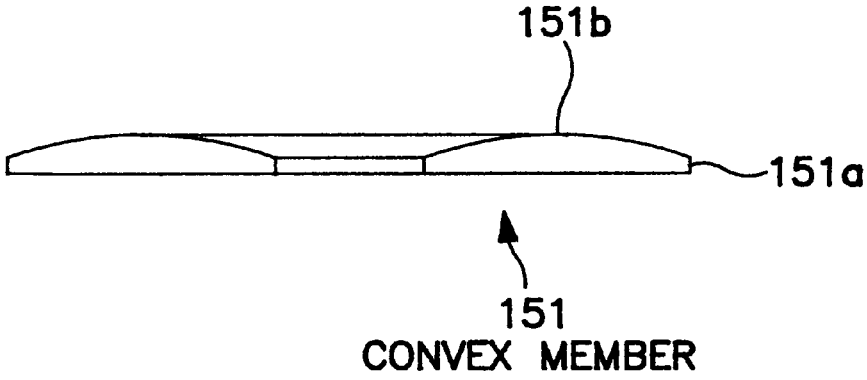
FIG. 11B is a cross-sectional view conceptually showing the convex member shown in FIG. 11A.
Figure 12:
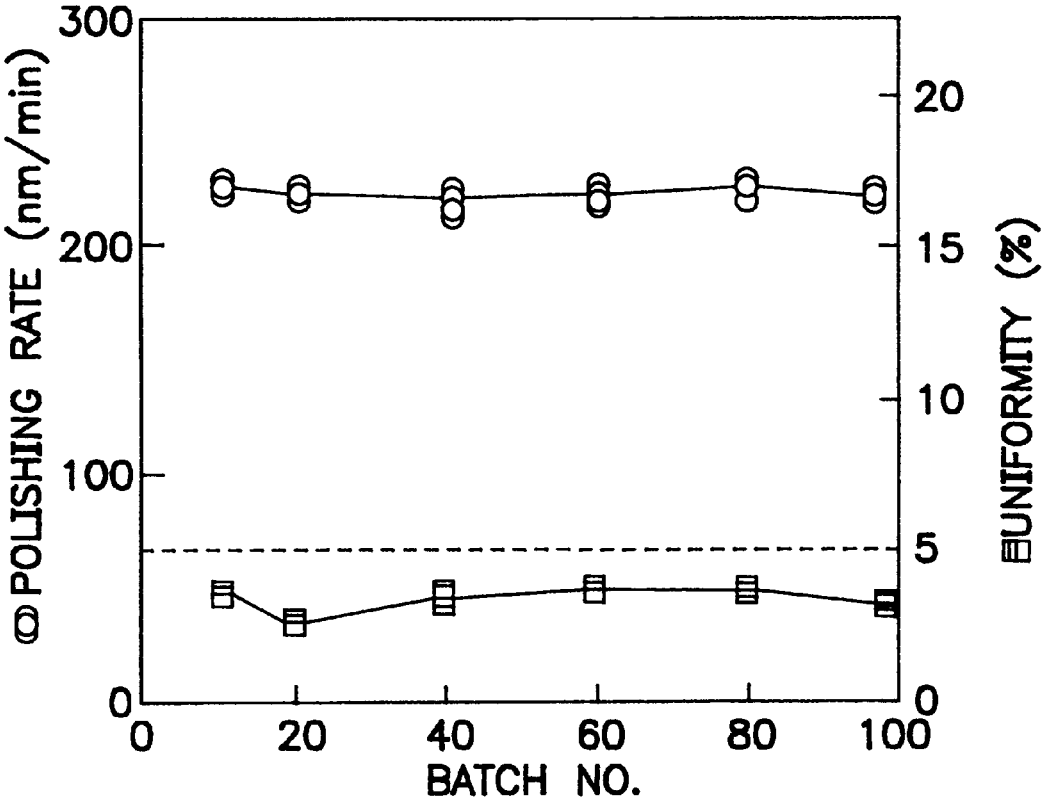
FIG. 12 is a graph showing the variation of polishing, rate and polishing uniformity of wafers, according to the invention.

FIGS. 11A and 11B show the convex member 151, which is shaped to be a ring-shape. The convex member 151 is designed to have a flat surface to be pressed against the turn table 21, and a convex surface to be pressed against the polishing pad 10. For instance, the convex member 151 is designed to have a base thickness of about 10 mm and have the difference of 20 $\mu$m to 1 mm between the thickest center portion 151*b* and the thinnest peripheral portion 151*a*. The convex member 151 may be made of polyvinyl-chloride (PVC) or acrylic or thin stainless steel film.

The convex member 151 is adhesively fixed to the. elastic member 14 with a double-sided tape or the like. The combination of the convex member 151 and the elastic member 14 is adhesively fixed to the bottom surface of the turn table 21. In the same manner as the before described embodiments, the polishing pad 10 is attached to the turn table 21 by the stretch-holding technique. In this embodiment, when the polishing pad 10 is pressed against the silicon wafer 100, the pressure is adjusted to be greater at the center of the silicon wafer 100 and to be smaller at the periphery thereof. As a result, the distribution uniformity of polishing rate on the silicon wafer 100 can be more improved. Because the elastic member 14 and the convex member 151 are fixed to each other in advance, thus fabricated structure (14 and 151) can be installed to the turn table 21 easily.

TEST OF PERFORMANCE

Now, the result of a performance test of the invention is described. In this test, the polishing apparatus shown in FIG. 10, and the polishing pad and the elastic member shown in FIG. 8 are used.

The polishing layer 32 of the polishing pad is of Rodel IC1000. A polyethylene sheet is used for the support layer 12. The polishing layer 32 and the support layer 12 are designed to have thickness of 1.3 mm and 0.05 mm, respectively. The polishing layer 32 is provided with the grooves 35 having a width of 3 mm and a depth of 0.5 mm. The grooves 35 are arranged both longitudinally and latitudinally with a spacing of 10 mm. The polishing layer 32 and the support layer 12 are adhesively-bonded to each other with a double-sided tape.

The elastic member 29 is made of nitrile rubber. The elastic member 29 is shaped to be a flat ring having a thickness of 10 mm. The elastic member 29 is provided with the grooves 30 having a width of 1 mm and a depth of 7 mm. The grooves 30 are arranged both in longitudinal and latitudinal directions with 20 mm of spacing from the adjacent grooves.

The convex member 151 is made of polyvinyl-chloride to have a base thickness of about 10 mm and have the difference of 400 $\mu$m between the thickest portion 151*b* at the center and the thinnest portion 151*a* at the periphery. The convex member 151 is adhesively-bonded to the elastic member 29 with a double-sided tape, or the like. Thus bonded structure of the convex member 151 and the elastic member 29 is adhesively-bonded to the bottom surface of the turn table 21 with a double-sided tape, or the like.

The polishing pad (12 and 32) is attached to the turn-table 21 as follows: First, the polishing pad (12 and 32) is fixed at the inner and periphery edges to the inner ring 36 and the periphery ring 34, respectively. Next, the polishing pad (12 and 32) is positioned below the turn table 21. Then, the inner ring 36 and periphery ring 34 are fixed to the turn table 21 with bolts 35 and 37, respectively, to stretch and hold the polishing pad (12 and 32) to the turn table 21.

In the test, thermal oxidized layers formed on one hundred batches (five hundred pieces) of 8-inch silicon wafers have been polished and the variation of polishing rate was measured. A polishing slurry was made of a KOH solution suspended with silica ($SiO_2$).

FIG. 10 shows the result of the test, including the variation of polishing rate and polishing uniformity among the 100 batches of wafers. As shown in the graph, according to the invention, each variation of polishing uniformity and polishing rate (200 nm/min) is kept at less than 5% over a long period of time corresponding to 100 batches (500 pieces). Accordingly, it is clear that the problem of the conventional apparatus, that is non-uniformity of polishing rate, is solved by the invention.

Figure 13:
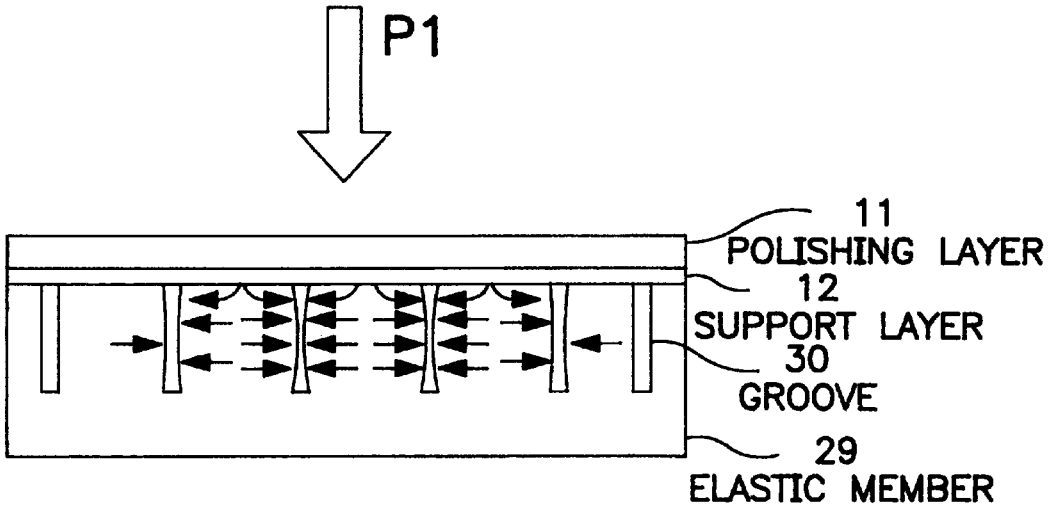
FIG. 13 is a cross-sectional view conceptually showing the distribution of stress which is generated inside an elastic member of the polishing apparatus according to the third preferred embodiment, shown in FIG. 6.
Figure 14:
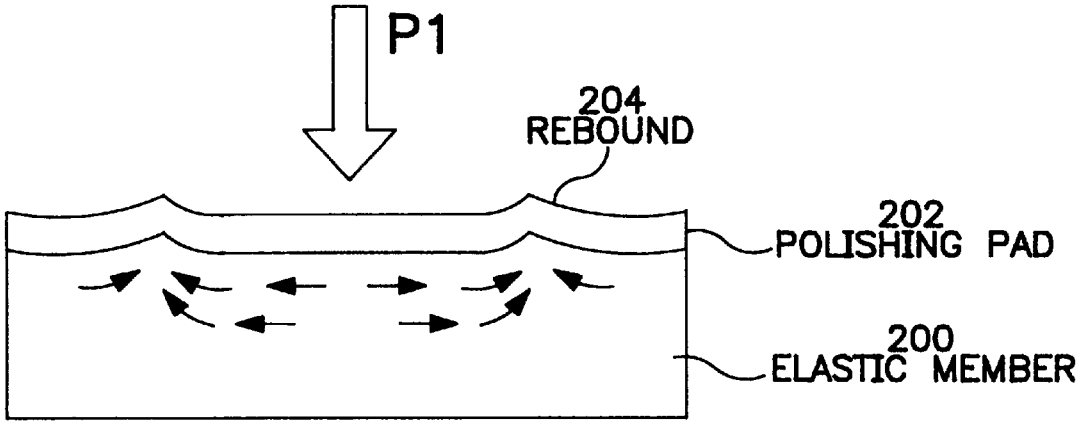
FIG. 14 is a cross-sectional view conceptually showing the distribution of stress which is generated inside an elastic member of a conventional polishing apparatus.

FIG. 13 shows the distribution of stress which is generated inside the elastic member 29, according to the third preferred embodiment, shown in FIG. 6. FIG. 14 shows the distribution of stress which is generated inside an elastic member 200 according to a conventional polishing apparatus. A polishing pad 202 is attached to the elastic member 200.

According to the conventional apparatus, shown in FIG. 14, when the elastic member 200 is depressed in response to pressure P1, neighboring regions of the depressed region are protruded hereinafter called "rebound protrusion") to have a volume corresponding to that of the depressed region. As a result, the wafer is locally pressed by the rebound protrusions 204 of the polishing pad 202 with larger pressure. As a result, the distribution of pressure applied from the polishing pad 202 to the wafer becomes not uniform, so that the polishing rate distribution on the wafer may not be uniform.

In contrast, according to the polishing apparatus of the third preferred embodiment, shown in FIG. 13, such rebound protrusions can be prevented, because the elastic member 29 is provided with grooves 30. As a result, the wafer can be polished with a uniform polishing rate distribution.

Figure 15:
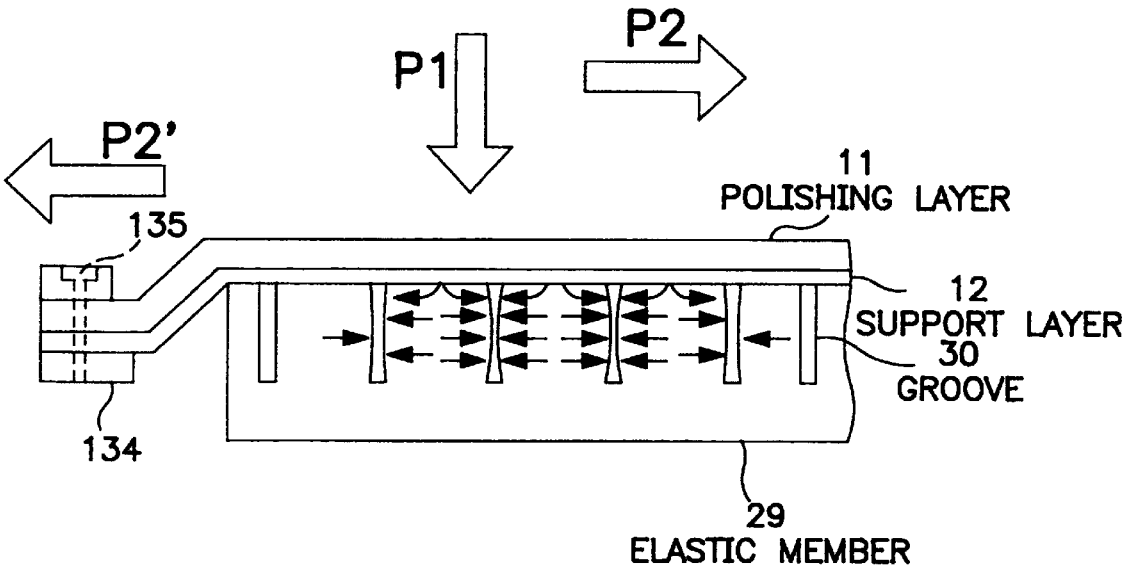
FIG. 15 is a cross-sectional view conceptually showing the distribution of stress which is generated inside the elastic member of the polishing apparatus according to the third preferred embodiment, shown in FIG. 6.
Figure 16:
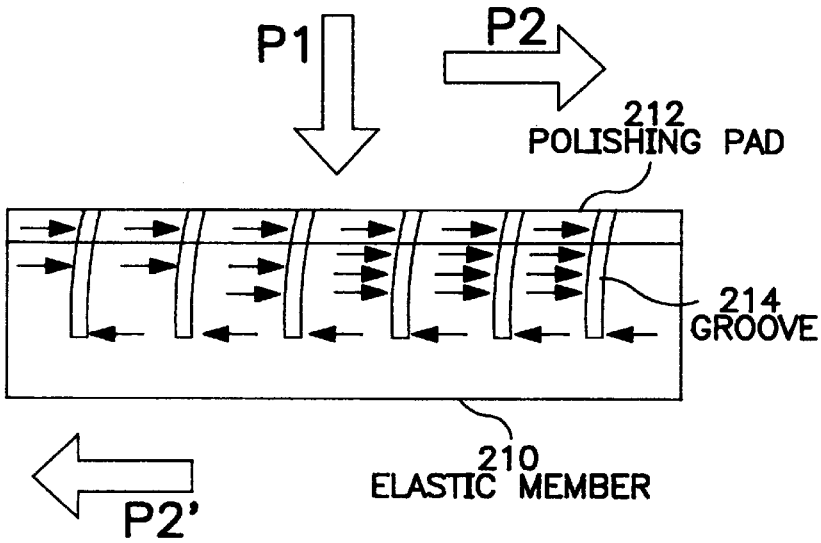
FIG. 16 is a cross-sectional view conceptually showing the distribution of stress which is generated inside an elastic member of another conventional polishing apparatus.

FIG. 15 shows the distribution of stress which is generated inside the elastic member 29, according to the third preferred embodiment, shown in FIG. 6. FIG. 16 shows the distribution of stress which is generated inside an elastic member 212 according to another conventional polishing apparatus. The elastic member 210 is attached with a polishing pad 212. The polishing pad 212 and the elastic member 210 are provided with grooves 214, which vertically extend through the polishing pad 212 and to the middle of the elastic member 210.

According to the conventional polishing apparatus, a shear stress P2 is generated during the polishing process, and is applied directly to the elastic member 210. Therefore, the elastic member 210 may be horizontally deformed. In this case, the elastic member 210 does not provide enough effect of cushioning, and therefore, the polishing pad 212 can not conform to the global waviness of the wafer surface. As a result, the polishing rate distribution may be not uniform on the wafer.

In contrast, according to the polishing apparatus of the third preferred embodiment, shown in FIG. 15, the support layer 12 is not only formed integrally (not separated by grooves), but also not expanded against a shear stress. In conventional case, shear stress is supported by the based elastic member. In this invention case, shear stress is supported by the inner and periphery rings (136 and 134). The elastic member 29 is pressed down and laterally deformed to provide an effect of cushioning, so that the polishing pad (11 and 12) can conform to global waviness of the wafer surface.

As described before, according to the invention, a polishing pad is prevented from having wrinkles, and therefore, silicon wafers can be polished uniformly over a long period of time.

It will be understood that the above description of the present invention is susceptible to various modifications, changes and adaptations, and the same are intended to be comprehended with the meaning and range of equivalents of the appended claims.

What is claimed is:

1. An apparatus for polishing a semiconductor wafer, comprising:

a polishing pad to be in contact with the semiconductor wafer;

a turn table which rotates the polishing pad; and an elastic member which is arranged between the turn table and the polishing pad, the elastic member being provided at a surface thereof with grooves that segment the surface into individual sections, and the polishing pad comprises a polishing layer which is made of a material having a good characteristic of slurry holding; and a support layer which is made of a rigid material having substantially continuous opposed surfaces and a sufficient thickness to prevent the polishing layer from becoming loose from the turn table, the polishing pad being attached to the turn table by a stretch-holding technique without adhesive bonding.

2. The apparatus according to claim 1, wherein the polishing layer is provided at a surface with grooves to segment the surface into individual sections thereon.

3. The apparatus according to claim 1, wherein the support layer is made of a material selected from polyethylene, super-macromolecule polyethylene, acrylic, teflon, polypropylene, polyurethane and polyester.

4. The apparatus according to claim 1, further comprises a convex member which is arranged between the turn table and the elastic member so that the polishing pad is pressured to the semiconductor wafer with an optimum distribution of pressure.

5. The apparatus according to claim 1, wherein the support layer has a thickness thinner than that of the polishing layer.

6. The apparatus according to claim 1, wherein the polishing layer and the support layer are formed integrally from the same material.

7. The apparatus according to claim 6, wherein the support layer is formed by impregnating a resin into the polishing layer.

8. The apparatus according to claim 7, wherein the resin is an urethane resin having a high viscosity.

9. The apparatus according to claim 7, wherein the resin is impregnated into a depth of about one-third of the thickness of the polishing layer.

10. The apparatus according to claim 1, wherein the elastic layer has a thickness of about 1–10 mm, the support layer has a thickness of about 0.05–1 mm, and the polishing layer has a thickness of about 1–2 mm.

11. An apparatus for polishing a semiconductor wafer, comprising:

a turn table which rotates during a polishing process;

a polishing pad which is attached to the turn table by a stretch-holding technique without adhesive bonding, and is in contact with the semiconductor wafer;

an elastic member which is arranged between the turn table and the polishing pad, and is provided at a surface with grooves to segment the surface into individual sections; and a convex member which is provided between the turn table and the elastic member so that the polishing pad is pressured to the semiconductor wafer with an optimum distribution of pressure, the polishing pad comprising:

(1) a polishing layer which is made of a material having a good characteristic of slurry holding; and (2) a support layer which is made of a rigid material having substantially continuous opposed surfaces and a thickness that is thinner than the polishing layer and thick enough to prevent the polishing layer from becoming loose from the turn table.

12. The apparatus according to claim 11, wherein the elastic layer has a thickness of about 1–10 mm, the support layer has a thickness of about 0.05–1 mm, and the polishing layer has a thickness of about 1–2 mm.

13. The apparatus according to claim 11, wherein the polishing layer is provided with grooves in a surface thereof, which grooves segment the surface into individual sections.

14. The apparatus according to claim 11, wherein the support layer is made from a material selected from polyethylene, super-macromolecule polyethylene, acrylic, Teflon, polypropylene, polyurethane and polyester.

15. The apparatus according to claim 11, wherein the polishing layer and the support layer are formed integrally from the same material.

16. The apparatus according to claim 15, wherein the support layer is formed by impregnating a resin into the polishing layer.

17. The apparatus according to claim 16, wherein the resin is an urethane resin having a high viscosity.

18. The apparatus according to claim 16, wherein the resin is impregnated into a depth of about one-third of the thickness of the polishing layer.

19. An apparatus for polishing a semiconductor wafer, comprising:

a polishing pad for contacting a semiconductor wafer;

a turn table for rotating the polishing pad; and an elastic member which is arranged between the turn table and the polishing pad, the polishing pad comprising:

(1) a polishing layer which is made of a material having a good characteristic of slurry holding; and (2) a support layer which is made of a rigid material having substantially continuous opposed surfaces and a thickness that is thinner than the polishing layer and thick enough to prevent the polishing layer from becoming loose from the turn table.

20. The apparatus according to claim 19, wherein the elastic layer has a thickness of about 1–10 mm, the support layer has a thickness of about 0.05–1 mm, and the polishing layer has a thickness of about 1–2 mm.

21. The apparatus according to claim 19, wherein the polishing layer is provided with grooves in a surface thereof, which grooves segment the surface into individual sections.

22. The apparatus according to claim 19, further comprising:

a convex member which is provided between the turn table and the elastic member so that the polishing pad is pressed to the semiconductor wafer with an optimum distribution of pressure.

* * * * *